US008213658B2

(12) United States Patent
Robineau

(10) Patent No.: US 8,213,658 B2
(45) Date of Patent: Jul. 3, 2012

(54) ACOUSTICAL HORN

(75) Inventor: Philippe Jean-Baptiste Robineau, Glasgow (GB)

(73) Assignee: Tannoy Limited, Lanarkshire (GB)

( * ) Notice: Subject to any disclaimer, the term of this patent is extended or adjusted under 35 U.S.C. 154(b) by 691 days.

(21) Appl. No.: 12/333,876

(22) Filed: Dec. 12, 2008

(65) Prior Publication Data

US 2009/0154751 A1 Jun. 18, 2009

(30) Foreign Application Priority Data

Dec. 14, 2007 (GB) ..... 0724395.9

(51) Int. Cl.
*H04R 1/20* (2006.01)
*G10K 11/02* (2006.01)

(52) U.S. Cl. ..... 381/340; 181/192

(58) Field of Classification Search ..... 181/177, 181/180, 192; 381/340
See application file for complete search history.

(56) References Cited

U.S. PATENT DOCUMENTS

| | | | | | |
|---|---|---|---|---|---|
| 2,994,399 | A * | 8/1961 | Zimmerman et al. | ..... | 181/152 |
| 4,176,731 | A | 12/1979 | Sinclair | | |
| 4,369,857 | A * | 1/1983 | Frazer et al. | ..... | 181/159 |
| 4,469,921 | A | 9/1984 | Kinoshita | | |
| 4,580,655 | A * | 4/1986 | Keele, Jr. | ..... | 181/192 |
| 4,893,695 | A * | 1/1990 | Tamura et al. | ..... | 181/151 |
| 5,285,025 | A | 2/1994 | Yoshioka | | |
| 5,878,148 | A | 3/1999 | Alexandrov | | |
| 5,925,856 | A * | 7/1999 | Meyer et al. | ..... | 181/152 |
| 6,028,947 | A * | 2/2000 | Faraone et al. | ..... | 381/340 |
| 6,059,069 | A | 5/2000 | Hughes, II | | |
| 6,079,514 | A * | 6/2000 | Zingali | ..... | 181/152 |
| 6,466,680 | B1 * | 10/2002 | Gelow et al. | ..... | 381/340 |
| 6,628,796 | B2 * | 9/2003 | Adamson | ..... | 381/342 |
| 7,068,805 | B2 | 6/2006 | Geddes | | |
| 2001/0036290 | A1 * | 11/2001 | Delgado, Jr. | ..... | 381/340 |
| 2003/0133584 | A1 * | 7/2003 | Werner | ..... | 381/338 |
| 2003/0228027 | A1 * | 12/2003 | Czerwinski | ..... | 381/342 |
| 2005/0094836 | A1 * | 5/2005 | Manrique | ..... | 381/342 |

OTHER PUBLICATIONS

Search Report dated Mar. 7, 2008, Great Britain patent application No. GB0724395.9

* cited by examiner

*Primary Examiner* — Jeremy Luks

(74) *Attorney, Agent, or Firm* — Alston & Bird LLP

(57) ABSTRACT

An acoustical horn having an inlet or throat, and an outlet or mouth wherein the shape of at least a portion of the horn between the throat and the mouth is defined by an exponential function including a negative exponential term.

15 Claims, 3 Drawing Sheets

ACOUSTICAL HORN

FIELD OF THE INVENTION

This invention relates to acoustical horns for loudspeakers, and more particularly for those known as compression drivers.

BACKGROUND OF THE INVENTION

Studies of the acoustical properties of horns for loudspeakers have for a long time focussed on how a horn could enhance the sound pressure radiated by a loudspeaker, by acting as an acoustical transformer.

Direct radiating loudspeakers are known to be inherently inefficient due to the mismatch between the low acoustical impedance presented by the receiving medium (the air) and the relatively high mechanical impedance of the vibrating source (generally a moving diaphragm).

The fundamental theory of acoustical horns is based on Webster's equation, which describes the motion of an unidirectional wave inside a hollow body with rigid walls and slowly varying cross-section S(x):

$$\frac{\partial^2 p}{\partial x^2} + \frac{1}{S}\frac{\partial S}{\partial x}\frac{\partial p}{\partial x} + k^2 p = 0$$

where p is the acoustic pressure, and k is the wave number

The end of the horn connected to the loudspeaker is referred to as the throat while the opposite end coupled to the ambient air is referred to as the mouth.

From Webster's equation, and assigning a particular mathematical function to the cross-section S along the propagation axis x, it is possible for a number of functions S(x) to derive the acoustical input impedance at the throat of the horn, if the radiating conditions at the mouth are known.

Analytical solutions for some specific functions are well known, for example in case of an exponentially varying cross-section:

$$S(x)=S_0\cdot(e^{2\cdot\pi\cdot f_c\cdot x})^2$$

where $S_0$ is the throat cross-section, and $f_c$ is the cut-off frequency of the horn.

The acoustic radiation impedance of an exponential horn, and few others like conical and hyperbolic horns can be found in reference works such as Olson (Acoustical Engineering, 1947), among others.

The exponential horn was long considered as an ideal choice because it exhibits a rapid though smooth rise in the acoustical throat impedance, thus achieving the expected gain in acoustic output from the lowest possible frequency.

On the other hand the conical horn was not rated so highly because of its poor loading characteristics at low frequencies.

However, there is another aspect to the properties of acoustical horns that had been overlooked in the early analysis which, as has been mentioned above, were mainly focused on efficiency and power output. In those days the electrical power delivered by amplifiers was limited to a few watts, a few tens at most.

Now, with modern power electronics, amplifiers can provide ample power for all applications, and the efficiency of the horn as an acoustic transformer is less of an issue, and more attention can be paid to horns as waveguides capable of controlling the directivity pattern of sound systems.

From this point of view exponential horns are certainly not ideal. This can be intuitively understood from the fact that the opening angle of an exponential horn varies greatly from the throat to the mouth: it is narrow at the throat and wide at the mouth. Relating this to the wavelength to radius ratio makes it easy to understand why the beamwidth of an exponential horn is wide at low frequencies and continuously narrows towards the high frequencies.

The conical horn having a constant opening angle from throat to mouth would seem to be the ideal candidate in terms of constant coverage. However, numerous experimental results have shown that this not the case. The typical behaviour of a conical horn shows a wide variation of beamwidth with frequency.

Often sound systems require different directivities in the horizontal and vertical planes. Hence a variation of the conical horn in the sectoral or radial horn: this has a constant but different opening angle, in the horizontal and vertical planes and hence a rectangular cross-section. However, radial horns inherit the shortcomings of conical horns (beaming), through not as acutely.

There have been numerous attempts to address the problem of better behaved and more constant directivity from acoustical horns, but none has been entirely satisfactory.

BRIEF SUMMARY OF THE INVENTION

The present invention aims to provide, at least in its preferred embodiments, more constant directivity than normally achievable from known acoustical horns.

In one aspect the invention provides an acoustical horn having an inlet or throat, and an outlet or mouth, wherein the shape of at least a portion of the horn between the throat and the mouth is defined by an exponential function including a negative exponential term.

Preferably, in said portion the cross-sectional dimensions of the horn orthogonal to an axis of propagation of the horn increase with distance along the axis of propagation in accordance with the following relationships:

$$y(x,\theta)=y_0\cdot(a\cdot e^{mx}-b\cdot e^{-mx})\cos\theta^{(1-\zeta d)}$$

$$z(x,\theta)=z_0\cdot(a'\cdot e^{m'x}-b'\cdot e^{-m'x})\sin\theta^{(1-\zeta d)}$$

where:

- x is the distance along the axis of propagation from the upstream end of the section;
- y, z are the cross-sectional dimensions of the horn orthogonally to x and to each other;
- $y_0$, $z_0$ are the cross-sectional dimensions at the upstream end of the section (x=0);
- θ is the polar angle about the axis of propagation ($0\leqq\theta<\pi/2$)
- a, a', b and b' are positive constants, preferably a, a'>1 and b, b'>0;
- m, m'=$2\pi f_c/c$ and $2\pi f'_c/c$ respectively where $f_c$ and $f'_c$ are cut-off frequencies of the horn determined by the y and z dimensions respectively and c is the velocity of sound in air;

- ζ is a parameter, $0\leqq\zeta<1$; and
- d is either unity or a function of x such that d increases from 0 at the upstream end of the portion to 1 at the downstream end of the portion.

In one embodiment d=1 and ζ tends to 1, and the cross-section of the portion is substantially rectangular.

In another embodiment ζ=0 and the cross-section of the portion is elliptical.

In a particular form of this embodiment, $y^2+z^2=R^2$ and the cross-section is circular and defined by;

$$R(x)=R_0(a\cdot e^{mx}-b\cdot e^{-mx})$$

where $R_0$ is the radius of the portion at the upstream end thereof.

In a further embodiment d=f(x) and the cross-section of the portion morphs from a first shape, preferably circular, at the upstream end of the portion to another shape at the downstream end.

If d=x/L (where L is the length of the portion from the upstream to the downstream end thereof) the cross-section morphs from one shape to the other linearly along the length of the portion. However, other morphing functions are possible, for example $d=(x/L)^{1/2}$ or $d=(x/L)^2$.

Our research indicates that suitable values for a, a', are $2 \leqq a, a' \leqq 3$, preferably $2.25 \leqq a, a' \leqq 2.75$, and more preferably a, a'=substantially 2.5. The values of a and a' may be but need not be equal.

Our research further indicates that suitable values for b, b' are $1 \leqq b, b' \leqq 2$, preferably $1.25 \leqq b, b' \leqq 1.75$, more preferably b, b'=substantially 1.5. The values of b and b' may be but need not be equal.

The invention also provides a loudspeaker comprising a horn as set forth above and means for delivering acoustic energy to the throat thereof.

The means for delivering acoustic energy may comprise at least two energy sources optimised for different frequency ranges.

The means for delivery acoustic energy may comprise at least one compression driver. Thus in a preferred form of the invention the driver is a dual concentric compression driver.

The use of a dual compression driver can result in the wavefront at the throat of the horn being coherent across the frequency range. This is a significant advantage compared to the acoustic sources hitherto used with horns, which consist of a HF compression driver and a separate mid-range compression driver each with its own horn. With such sources there is inevitably some interference between the HF and mid-range units in the cross-over frequency range. The known alternative of a combined unit comprising of an HF compression driver or other tweeter arranged concentrically in an unloaded directly-radiating (coned) mid-range unit cannot provide sound pressure levels in the mid-range comparable with a horn-loaded loudspeaker. Moreover it offers no scope for control of mid-range directivity because this is determined by the cone profile.

The use of such a combined unit with a horn as set forth above is also within the invention. It can provide some improvement in directivity, especially if the cone and preferably also the compression driver are provided with channelled (apertured) phase plugs to assist in developing a more coherent wavefront. The use of dual compression driver as discussed above is however preferred.

Whilst a horn according to the invention can be manufactured by any suitable known technique we prefer to sculpt it from a block of material rather than fabricate it. We have found that superior performance can result, particularly if the material is MDF (medium density fibreboard). We believe this is due to the monolithic nature of the structure providing rigidity, and the particulate nature of the material itself being acoustically absorbent and not predisposed to resonate.

This method of construction is of general application to acoustical horns, and therefore in another aspect the invention provides an acoustical horn which has been sculpted from a block of MDF.

The block may be made up of a plurality of layers joined together one upon another.

Preferably the layers are disposed perpendicular to the propagation axis of the horn.

BRIEF DESCRIPTION OF THE SEVERAL VIEWS OF THE DRAWING(S)

The invention will be described merely by way of example with reference to the accompanying drawings wherein.

DETAILED DESCRIPTION OF THE INVENTION

Figure 1:
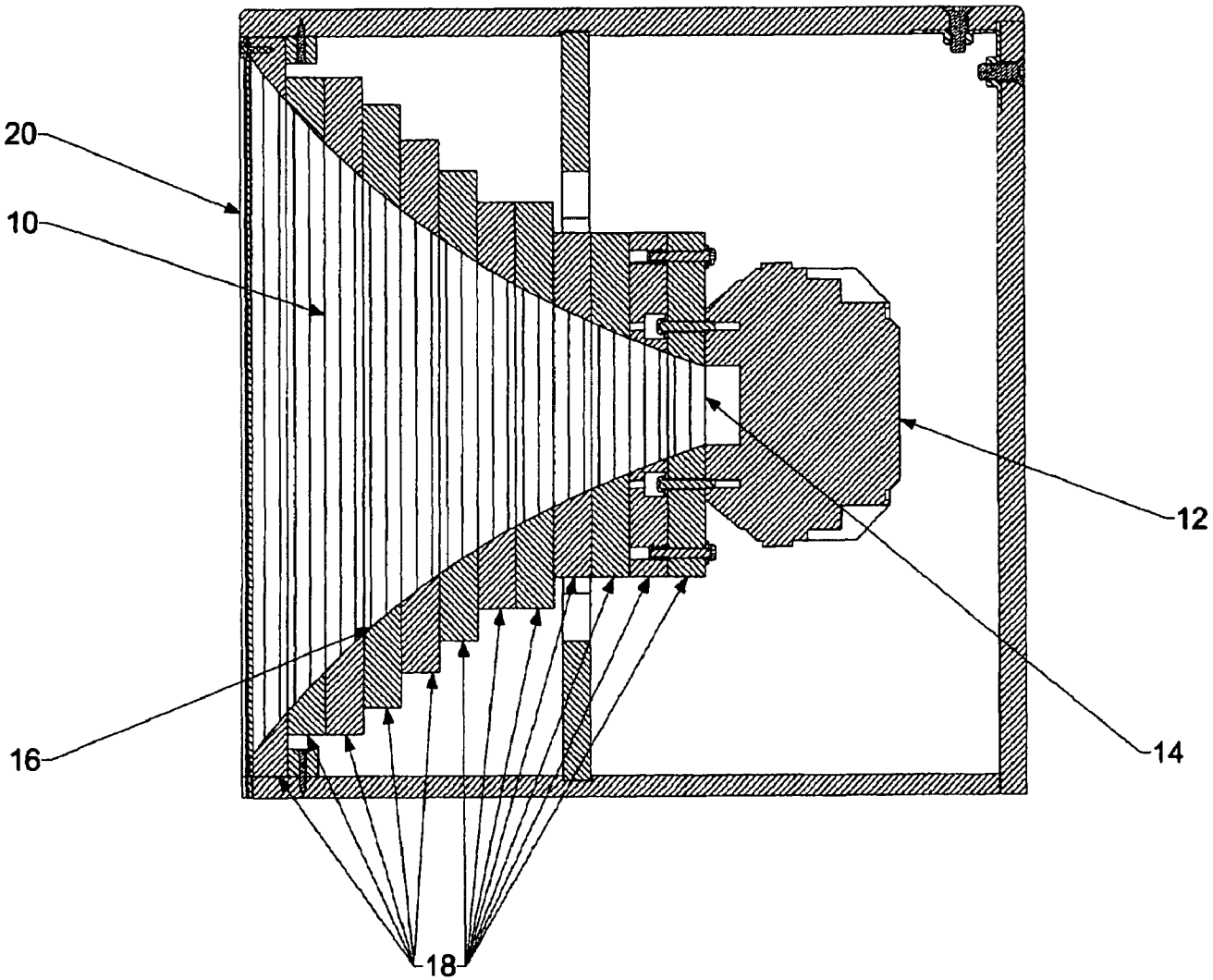
FIG. 1 is a longitudinal section through a loudspeaker according to the invention.

Referring to FIG. 1, a loudspeaker according to the invention comprises a circular-section horn 10 and a dual concentric compression driver 12 at the throat 14 of the horn. The horn has a novel internal profile 16, as hereinafter described, machined from a block of medium density fibreboard, itself made up of a number (here twelve) of 35 mm—thick layers 18 glued together. The layers each initially are ring-shaped, the aperture in each being smaller than the finished contour of the section of the profile 14 defined by the ring. After assembly of the rings into a monolithic block, the block is sculpted by CNC machining (eg. here by turning about its axis of propagation) to produce the profile 16, which in this example extends the full length of the horn from the throat 14 to the mouth 20.

Figure 2:
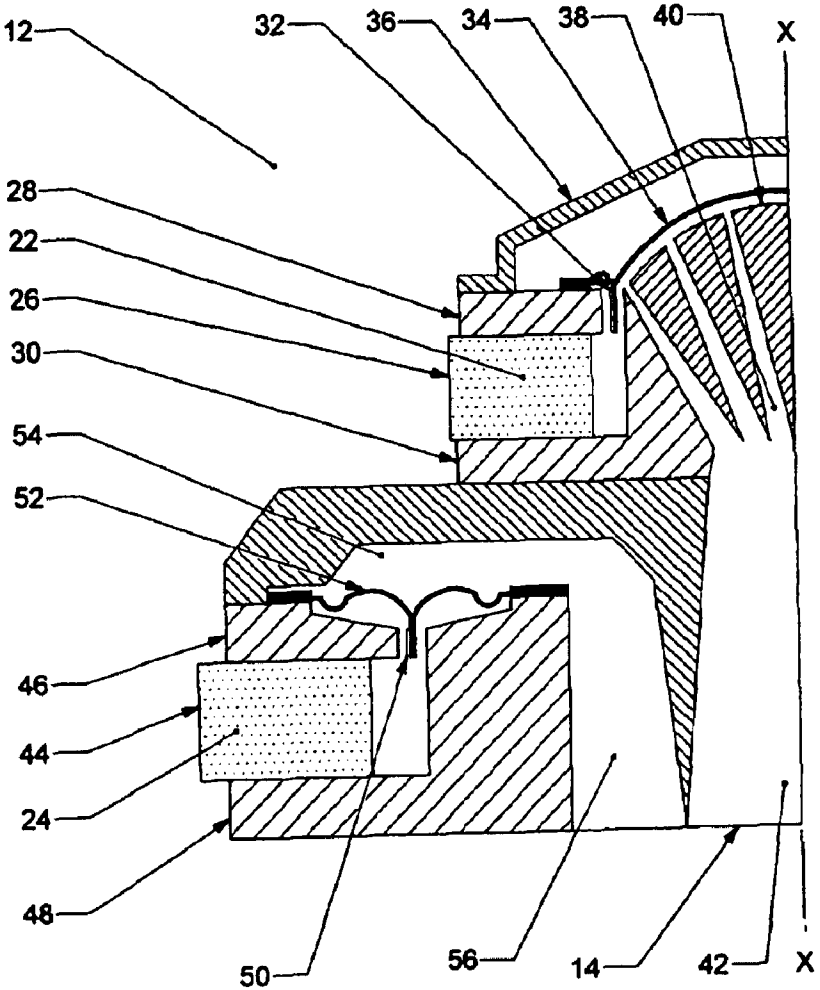
FIG. 2 is an enlarged view of part of the speaker of FIG. 1.

Referring to FIG. 2, the dual compression driver 12 (shown in half section on longitudinal axis X-X) comprises a high frequency (HF) unit 22 and a mid-range (MF) unit 24.

The HF unit comprises an annular magnet 26 and magnetic circuit components 28, 30 defining an air gap in which is disposed a voice coil 32. The voice coil is connected to a diaphragm 34, the central part of which is in the form of a dome with its concave surface facing the direction of propagation. The periphery of the diaphragm 34 is anchored by a cover 36 which creates a sealed cavity behind the diaphragm.

The diaphragm radiates through annular apertures 38 in a phase plug 40 and thence into a flared circular section passage 42. As known per se the channels in the phase plug deliver a coherent wavefront to the passage 42. Also as known per se, the volume of the space (the compression chamber) between the diaphragm and the back of the phase plug is kept to a minimum.

Likewise the MF unit comprises an annular magnet 44, magnetic circuit components 46, 48 defining an air gap and a voice coil 50 in the air gap. The voice coil drives an annular diaphragm 52 which loads the air in an annular compression chamber 54, from which sound waves are directed to a flared annular passage 56. The chamber 54 is shaped such that sound waves generated by different parts of the diaphragm 52 are reflected from different parts of the chamber walls so that the path length to the end of the passage 56 is constant and a coherent wavefront issues from the passage 56.

The acoustic path length of the MF unit to the end of the passage 56 is the same as that of the HF unit of the end of the passage 42. The ends of these passages lie in a common plane which is the assembled loudspeaker is at the throat 14 of the horn.

The profile of the horn takes the following form:

$$y(x)=R_0\cdot(a\cdot e^{m\cdot x}-b\cdot e^{-m\cdot x})$$

where $R_0$ is the horn at the throat (x=0), a is a constant >1, b is a constant >0 m is a constant related to the cut-off frequency of the horn: $m=2.\pi.f_c/c$

As can be understood, the positive exponential term is "softened" by the negative exponential term.

Figure 3:
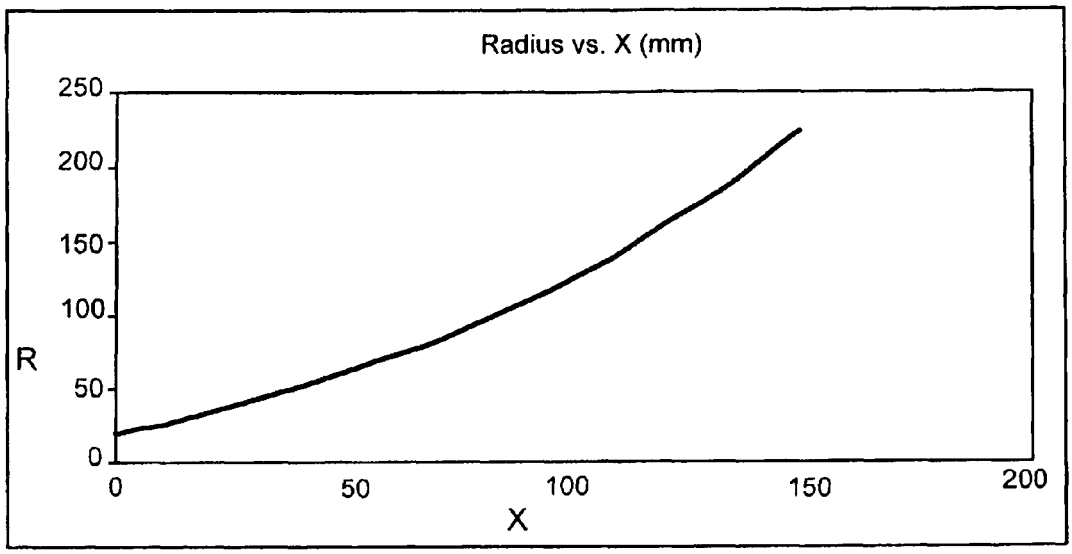
FIG. 3 is a plot of horn radius against axial position.

An example of horn profile according to the invention is shown in FIG. 3. The values of the parameters were taken as a=2.5, b=1.5, $f_c$=600 Hz. We have found by experiment that optimum values for a are between 2 and 3, and for b between 1 and 2.

Figure 4:
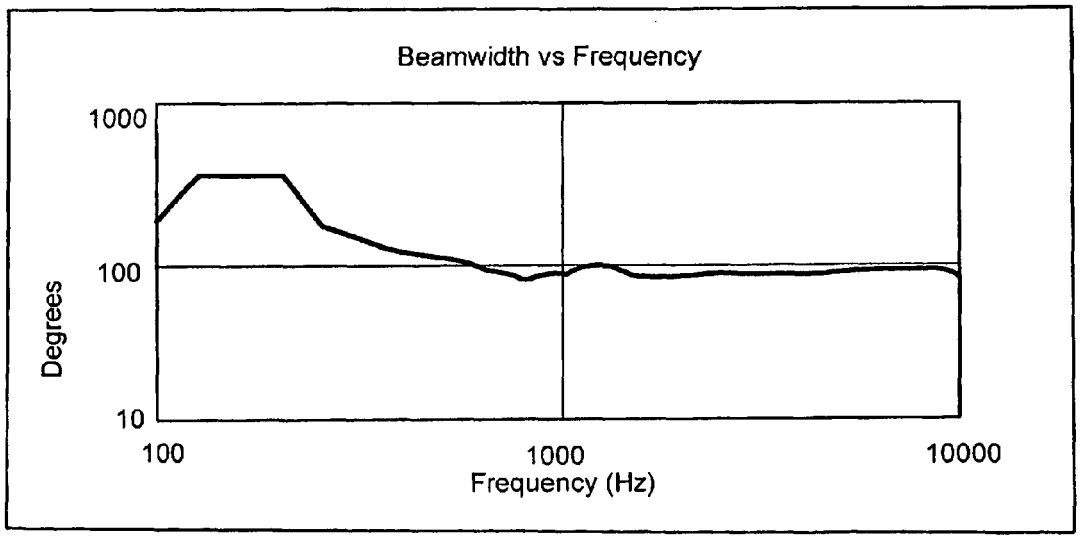
FIG. 4 is a beamwidth vs frequency plot for a loudspeaker according to the invention.

FIG. 4 shows the beamwidth of the horn of FIG. 3. As can be seen, the beamwidth (90° nominal) is extremely well maintained from 500 Hz to up to 10 kHz.

The equation: $y(x)=R_0\cdot(a\cdot e^{m.x}-b\cdot e^{-m.x})$ can fully describe the horn flare only in the case of an axi-symmetrical shape (ie. of circular cross-section).

As mentioned earlier, often different directivity patterns are required in different planes, generally in the horizontal and vertical planes. It is straightforward to use the above equation for both planes, selecting parameters a, b and m individually for each plane.

Thus, we can use variable y for the horizontal plane, and another variable z for the vertical plane.

The equations become then:

$$y(x)=R_0\cdot(a\cdot e^{m.x}-b\cdot e^{-m.x})$$

$$z(x)=R_0\cdot(a'\cdot e^{m'.x}-b'\cdot e^{-m'.x})$$

One can observe that these two equations are still not sufficient to describe entirely the horn profile, since in the (y,z) plane perpendicular to the propagation axis x, only two points are defined from the equations. An exception is for x=0 (at the throat) as in this example the horn connects to a compression driver with a circular exit.

A practical horn according to the invention, if not of circular section at the mouth, often will be rectangular (perhaps with the corners relieved with blending radii) or elliptical. The cross-section at intermediate points, in addition to increasing from throat to mouth in accordance with the equations above morphs from circular to whatever is the final cross-sectional shape over at least a portion of the length of the horn.

It is possible to express the morphing mathematically, for both the rectangular and the elliptical cases, and for any shape of cross-section in between.

If we introduce the polar angle θ in the plane with orthogonal axis y and z corresponding to horizontal and vertical planes respectively, we can define the contour of the horn for $0\leqq\theta\ \pi/2$ by the formulae:

$$y(x,\theta)=y(x)\cdot\cos(\theta)^{(1-\zeta\cdot(x/L))}$$

$$z(x,\theta)=z(x)\cdot\sin(\theta)^{(1-\zeta\cdot(x/L))}$$

where y(x) and z(x) are obtained from the previous equation,

L in the length of the horn between throat and mouth along the x axis,

ζ is a constant, with $0\leqq\zeta<1$

It can be seen that for ζ=0, the cross-section takes an elliptical shape, whereas when ζ tends towards 1 the shape tends towards a rectangle.

Having defined the cross-section of the horn in one quarter is enough since the others are found by applying symmetries.

In this example, the morphing occurs in linear proportion to the distance x along the has as a fraction of its total length L. Other variations functions of course are possible, and thus $(1-\zeta(x/L))$ can be more generally expressed as $(1-\zeta(d))$ where either d=1 or d=f(x) and $0\leqq d\leqq 1$ for $0\leqq x\leqq L$.

For the particular case where the horn cross-section is of constant shape over the length L, but merely gets larger, d=1.

It will be appreciated that the horn profile of the invention can be applied over the full length of the horn or only over part of it. For example it can be provided just at an upstream portion section where it may be a morphing section, or just at a downstream portion. It can be either preceded or followed by a section of the horn whose shape follows some other profile.

Each feature disclosed in this specification (which term includes the claims) and/or shown in the drawings may be incorporated in the invention independently of other disclosed and/or illustrated features. In particular but without limitation the features of any of the claims dependent from a particular independent claim may be introduced into that independent claim in any combination.

Statements in this specification of the "objects of the invention" relate to preferred embodiments of the invention, but not necessarily to all embodiments of the invention falling within the claims.

That which is claimed:

1. An acoustical horn having an inlet or throat, and an outlet or mouth, wherein the shape of at least a portion of the horn between the throat and the mouth is defined by an exponential function including a negative exponential term, wherein in said portion the cross-sectional dimensions of the horn orthogonal to an axis of propagation of the horn increase with distance along the axis of propagation in accordance with the following relationships:

$$y(x,\theta)=y_0\cdot(a\cdot e^{mx}-b\cdot e^{-mx})\cos\theta^{(1-\zeta d)}$$

$$z(x,\theta)=z_0\cdot(a'\cdot e^{m'x}-b'\cdot e^{-m'x})\sin\theta^{(1-\zeta d)}$$

where x is the distance along the axis of propagation from the upstream end of the section;

y, z are the cross-sectional dimensions of the horn orthogonally to x and to each other;

$v_0$, $z_0$ are the cross-sectional dimensions at the upstream end of the section (x=0);

θ is the polar angle about the axis of propagation ($0<\theta<\pi/2$) a, a', b' and b are positive constants, preferably a, a'>1 and b, b'>0;

$m,m'=2\pi f_c/c$ and $2\pi f'_c/c$ respectively where $f_c$ and $f'_c$ are cut-off frequencies of the horn determined by the y and z dimensions respectively and c is the velocity of sound in air;

ζ is a parameter, $0<\zeta<1$; and d is either unity or a function of x such that d increases from 0 at the upstream end of the portion to 1 at the downstream end of the portion.

2. A horn according to claim 1, wherein d =1 and ζ tends to 1, and the cross-section of the portion is substantially rectangular.

3. A horn according to claim 1, wherein ζ=0 and the cross-section of the portion is elliptical.

4. A horn according to claim 3, wherein $y^2+z^2=R^2$ and the cross-section is circular and defined by;

$$R(x)=R_0\ (a\cdot e^{mx}-b\cdot e^{-mx})$$

where $R_0$ is the radius of the portion at the upstream end thereof.

5. A horn according to claim 1, wherein d =f(x) and the cross-section of the portion morphs from a first shape, preferably circular, at the upstream end of the portion to another shape at the downstream end.

6. A horn according to claim 5, wherein d =x/L where L is the length of the portion from the upstream to the downstream end thereof.

7. A horn according to claim 1 wherein 2 <a <3.

8. A horn according to claim 1 wherein 1 <b <2.

9. A horn according to claim 1, having been sculpted from a block of material.

10. A horn according to claim 9, wherein the material is medium density fibre board (MDF).

11. A horn according to claim 9, wherein the block is made up of a plurality of layers joined together one upon another.

12. A loudspeaker comprising a horn according to claim 1, and means for delivering acoustic energy to the throat thereof.

13. A loudspeaker according to claim 12, wherein the means for delivering acoustic energy comprises at least two energy sources optimized for different frequency ranges.

14. A loudspeaker according to claim 12, wherein the means for delivering acoustic energy comprises at least one compression driver.

15. A loudspeaker according to claim 14, wherein the driver is a dual concentric compression driver.

* * * * *

UNITED STATES PATENT AND TRADEMARK OFFICE

CERTIFICATE OF CORRECTION

PATENT NO. : 8,213,658 B2
APPLICATION NO. : 12/333876
DATED : July 3, 2012
INVENTOR(S) : Robineau It is certified that error appears in the above-identified patent and that said Letters Patent is hereby corrected as shown below:

In the Claims

Column 6

Line 41, "$v_0$" should read --$y_0$--

Line 44, "<" should read --≤--

Line 50, "$0 < \zeta < 1$" should read --$0 \leq \zeta < 1$--

Column 7

Line 4, "$2 < a < 3$" should read --$2 \leq a \leq 3$--

Line 5, "$1 < b < 2$" should read --$1 \leq b \leq 2$--

Signed and Sealed this
Fourteenth Day of January, 2014

Michelle K. Lee

Michelle K. Lee
*Deputy Director of the United States Patent and Trademark Office*